US007163385B2

(12) United States Patent
Gharib et al.

(10) Patent No.: US 7,163,385 B2
(45) Date of Patent: Jan. 16, 2007

(54) HYDROIMPEDANCE PUMP

(75) Inventors: Morteza Gharib, San Marino, CA (US); Anna Iwaniec, Sierra Madre, CA (US); Jijie Zhou, Pasadena, CA (US); Flavio Noca, Altadena, CA (US)

(73) Assignee: California Institute of Technology, Pasadena, CA (US)

( * ) Notice: Subject to any disclaimer, the term of this patent is extended or adjusted under 35 U.S.C. 154(b) by 122 days.

(21) Appl. No.: 10/382,721

(22) Filed: Mar. 4, 2003

(65) Prior Publication Data

US 2004/0101414 A1 May 27, 2004

Related U.S. Application Data

(60) Provisional application No. 60/428,126, filed on Nov. 21, 2002.

(51) Int. Cl.
*F04B 43/08* (2006.01)

(52) U.S. Cl. ..... 417/474; 417/478

(58) Field of Classification Search ..... 417/474, 417/478, 479, 475, 471.1, 477.1
See application file for complete search history.

(56) References Cited

U.S. PATENT DOCUMENTS

| | | | | |
|---|---|---|---|---|
| 2,888,877 | A | 6/1959 | Shellman et al. | |
| 3,304,386 | A | 2/1967 | Shlesinger, Jr. | |
| 3,349,716 | A | 10/1967 | Weber | |
| 3,406,633 | A * | 10/1968 | Schomburg | 417/394 |
| 4,515,536 | A * | 5/1985 | van Os | 417/394 |
| 4,650,471 | A * | 3/1987 | Tamari | 604/153 |
| 4,963,845 | A | 10/1990 | Collier | |
| 5,088,522 | A * | 2/1992 | Rath et al. | 138/119 |
| 5,273,406 | A * | 12/1993 | Feygin | 417/474 |
| 5,525,041 | A * | 6/1996 | Deak | 417/63 |
| 5,573,384 | A | 11/1996 | Ernsberger | |
| 5,593,290 | A * | 1/1997 | Greisch et al. | 417/478 |
| 6,007,309 | A * | 12/1999 | Hartley | 417/322 |
| 6,227,809 | B1 * | 5/2001 | Forster et al. | 417/53 |
| 6,254,355 | B1 | 7/2001 | Gharib | 417/53 |
| 6,267,570 | B1 * | 7/2001 | Armando | 417/478 |
| 6,394,759 | B1 | 5/2002 | Parce | |
| 6,408,878 | B1 | 6/2002 | Unger et al. | |
| 6,450,773 | B1 * | 9/2002 | Upton | 417/53 |
| 6,506,025 | B1 | 1/2003 | Gharib | |
| 2002/0064469 | A1 | 5/2002 | Palumbo | |

* cited by examiner

*Primary Examiner*—Charles G. Freay
(74) *Attorney, Agent, or Firm*—Fish & Richardson P.C.

(57) ABSTRACT

A hydro-elastic pumping system formed from an elastic tube element having attached end members with different hydroimpedance properties, wherein the elastic element is pinched with certain frequency and duty cycle to form asymmetric forces that pump fluid.

33 Claims, 6 Drawing Sheets

HYDROIMPEDANCE PUMP

CROSS-REFERENCE TO RELATED APPLICATION

The present application claims the benefit of provisional application Ser. No. 60/428,126, filed Nov. 21, 2002.

FIELD OF THE INVENTION

The present invention generally relates to a fluid pumping system and methods for pumping fluid. More particularly, the present invention relates to the valveless hydro-elastic pumping system formed from an elastic tube element having end members with different hydroimpedance properties, wherein the elastic element is pinched with certain frequency and duty cycle to form asymmetric forces that pump fluid.

BACKGROUND OF THE INVENTION

Many different pump systems are known, for example, impeller pumps, gear pumps, piston pumps, vacuum pumps and the like. A typical pump uses an impeller or a set of blades, which spins to push a flow of fluid in a direction. Less conventional pump designs without impellers are also known, such as peristaltic pumps, magnetic flux pumps or diaphragm pumps that are used in places where the fluid can actually be damaged or the setup space is sufficient. Special features for pumping of red blood cells that avoid damaging the red blood cells are not available in the current pump designs.

U.S. Pat. No. 6,254,355 to Morteza Gharib, one of co-inventors of the present invention, the entire contents of which are incorporated herein by reference, discloses a valveless fluid system based on pinch-off actuation of an elastic tube channel at a location situated asymmetrically with respect to its two ends. Means of pinch-off actuation can be either electromagnetic, pneumatic, mechanical, or the like. A critical condition for the operation of the "hydro-elastic pump" therein is in having the elastic tube attached to other segments that have a different compliance (such as elasticity). This difference in the elastic properties facilitates elastic wave reflection in terms of local or global dynamic change of the tube's cross-section which results in the establishment of a pressure difference across the actuator and thus unidirectional movement of fluid. The intensity and direction of this flow depends on the frequency, duty cycle, and elastic properties of the tube.

The elastic wave reflection of a "hydro-elastic pump" depends on the hydroimpedance of the segments. In the prior art hydro-elastic pump, it was required that the segments to be stiffer either by using a different material or using reinforcement. To overcome the limiting conditions of the prior hydro-elastic pump systems, it is disclosed herein to attach any end member with different hydroimpedance (one special kind of impedances) to the end sections of the hydro-elastic pump for achieving a non-rotary bladeless and valveless pumping operation.

By definition impedance is defined as a combination of resistance and reactance of a system to a flow of alternating current of a single frequency. In this respect, impedance difference between two adjacent systems determines the level of power that will be transmitted or reflected between these two systems. Impedance is a very useful concept in the subject of power delivery. It provides information about the load being driven by the power source. For the output torque of an automobile transmission, the impedance is the output torque divided by the angular velocity that such torque will sustain, For a jet engine, the impedance is the thrust (force) divided by the air-speed that such thrust will sustain, and for a fluid pump, the impedance is the pressure it delivers divided by the volume flow rate that such pressure sustains. In general, an impedance is the ratio of a force or other physical imposition capable of power delivery, to the reaction that such imposition can sustain, where the reaction is defined such that the product of the imposition and sustained reaction has the units of energy per unit time, or power.

For most mechanical systems, a device'impedance varies with the conditions of the situation (such as what slope the automobile is climbing, or the viscosity of the fluid being pumped by the pump), but an electrical impedance will either be a constant value or it will depend on the frequency component of the driving signal.

It is one aspect of the present invention to provide a hydroimpedance pumping system comprising changing a shape of an elastic element in a way which increases a pressure in a first end member of the elastic element more than that in a second end member of the elastic element to move fluid between the first and the second segments based on a pressure differential, wherein the elastic element has end members with different hydroimpedance attached to each end of the elastic element.

SUMMARY OF THE INVENTION

It is one object of the present invention to provide a valveless pump comprising an elastic element having a length with a first end and a second end, and a first end member attached to the first end of the elastic element and a second end member attached to the second end, wherein the first end member has an impedance different from an impedance of the second end member. In one preferred embodiment, the pump further comprises pressure change means for inducing a pressure increase and a pressure decrease into the first and second end members, in a way which causes a pressure difference between the first and second end members, and causes a pumping action based on the pressure difference.

It is another object of the present invention to provide a valveless pump comprising an elastic element having a length with a first flexible wall segment and a spaced apart second flexible wall segment, and a first external chamber mounted over the first flexible wall segment and a second external chamber mounted over the second flexible wall segment, wherein a pressure is applied through the first external chamber onto the first flexible wall segment that is different from a pressure applied onto the second flexible wall segment. In one embodiment, the pump further comprises pressure change means for inducing a pressure increase and a pressure decrease into the first and second flexible wall segments, in a way which causes a pressure difference between the first and second segments, and causes a pumping action based on the pressure difference.

It is still another object of the present invention to provide a valveless pump comprising an elastic element having a length with a first end and a second end, and a first pressure changing element disposed at about the first end and a second pressure changing element disposed at about the second end. In one embodiment, the pump further comprises pressure change means for inducing a pressure increase and a pressure decrease into the first and second ends, in a way which causes a pressure difference between the first and second ends, and causes a pumping action based on the pressure difference, wherein the first and second pressure changing elements are capable of producing partial or complete pinch-off to reflect waves generated by the pressure change means.

It is a further object of the present invention to provide a method for pumping fluid comprising changing a shape of or pinching an elastic element in a way which increases a pressure in a first end member of the elastic element more than a pressure in a second end member of the elastic element without valve action, to cause a pressure differential, wherein the end members have different impedance, and using the pressure differential to move fluid between the first and second end members.

BRIEF DESCRIPTION OF THE DRAWINGS

Further features and advantages of the present invention will become apparent to one of skill in the art in view of the Detailed Description of Exemplary Embodiments that follows, when considered together with the attached drawings and claims.

DETAILED DESCRIPTION OF EXEMPLARY EMBODIMENTS

The preferred embodiments of the present invention described below relate particularly to a fluid pumping system based on the end members with different hydroimpedance that are attached to the elastic tube element and a pinching actuation of the elastic tube element. While the description sets forth various embodiment specific details, it will be appreciated that the description is illustrative only and should not be construed in any way as limiting the invention. Furthermore, various applications of the invention, and modifications thereto, which may occur to those who are skilled in the art, are also encompassed by the general concepts described below.

The hydroimpedance, Z (or abbreviated as "impedance"), of the present invention is intended herein to mean frequency dependent resistance applied to a hydrofluidic pumping system.

One good example to distinguish the current valveless hydroimpedance pump principles from a conventional peristaltic pump is illustrated here for reference. A primitive vertebrate heart tube begins to pump blood before endocardial cushions, precursors of the future valves, begin to form. In vivo observations of intracardiac blood flow in early embryonic stages of zebrafish (*Danio rerio*) demonstrate that unidirectional flow through the heart, with little regurgitation, is still achieved despite the lack of functioning valves. Remarkably, the mechanistic action of the pulsating heart tube does not appear to be peristaltic, but rather, a carefully coordinated series of oscillating contractions between the future ventricle and the outflow tract.

A distinguishing aspect of the hydroimpedance pump from traditional peristaltic pumping is the pattern with which the tube is pinched. For peristaltic pumping, it is required that the pump is pinched sequentially in order to move fluid unidirectionally. In the hydroimpedance pump, the pattern of pinching is determined by the pressure wave reflections that are required to sustain a pressure gradient across the pump. For example, with 3 pinching locations (shown in FIG. 7), this can be performed by pinch first the center, then together, the two outside locations. It can also be performed by pinching first the center, then the outside of the shorter section, followed by the outside of the longer section. These patterns are determined by the speed of the pressure wave, geometry of the pump, and the desired flow pattern to emerge from the pinching. Another distinguishing aspect of the hydroimpedance pump from traditional peristaltic pumping is that for a given location of pinching, geometrical condition and elastic property of the pump only a narrow band of pinching frequency and its harmonics will render unidirectional liquid pumping. In the traditional peristaltic pumping, the output will increase by increasing frequency of the squeezing or pinching.

Figure 1:
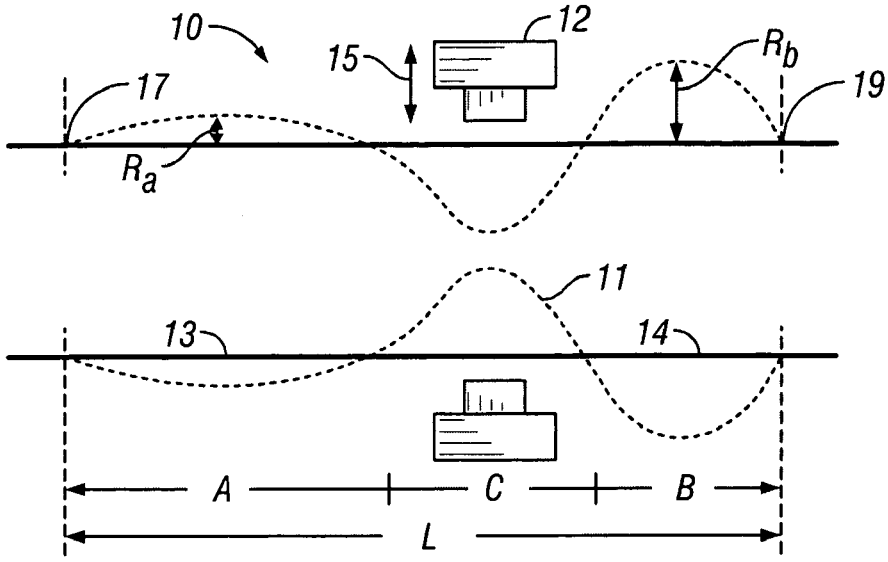
FIG. 1 (Prior Art)
FIG. 1 is a hydro elastic pump of the prior art for illustration.

The basic prior art hydro elastic pump and its principles of operations is illustrated in FIG. 1. U.S. Pat. No. 6,254,355 to Gharib, the entire contents of which are incorporated herein by reference, discloses a pump comprising a first and a second elastic tube segment, the first tube segment having a fluidic characteristic which is different than the second tube segment, and a pressure changing element, which induces a pressure increase and a pressure decrease into the first and second tube segments in a way that causes a pressure difference between the first and second tube segments resulting in a pumping action based on the pressure difference.

In one aspect as shown in FIG. 1 (prior art in U.S. Pat. No. 6,254,355), an elastic tube 10 is shown in solid lines. The elastic tube 10 has a length L from a first end 17 to a second end 19. This tube can be connected at each of its two ends 17 and 19 to other connecting channels or tubes of any type or shape. The elastic tube 10 is divided into three segments, labeled A, C and B. Segment C is situated between segment A 13 and segment B 14. FIG. 1 shows segment C situated to provide an asymmetric fluidic characteristic. In FIG. 1, the asymmetric characteristic is geometric arrangement. As shown, the length of segment A is not equal to the length of segment B. Alternatively, the length of segment A can be equal to the length of segment B, but the elasticity or diameter of the two segments A and B may be different from one another. The purpose is to allow the pumping action to materialize according to the principles of the hydro elastic pump system.

Segment C provides a means of compressing the diameter of segment C to reduce its volume. The pinching can be a partial obstruction or a complete obstruction. FIG. 1 shows the compression being partial; distorting the tube to the area shown as dashed lines 11. In this respect, the pinching means 12 can be a separately attached element configured in a "T" shaped piston/cylinder arrangement (as indicated by an arrow 15 in FIG. 1) or other means of pinch-off actuation by electromagnetic, pneumatic, mechanical forces, polymeric, or the like.

When segment C is compressed, the volume within segment C is displaced to the segments A and B, particularly for non-compressible liquid fluid. This causes a rapid expansion of the volumes in segment A and segment B as shown and defined by the enclosure lines 11. Similarly, for the "T" shaped piston/cylinder arrangement, the stroke of the piston displaces the volume in segment C to segments A and B.

Since the segment B is shorter than segment A in this illustration, the volume expansion in segment B is more than the volume expansion in segment A. Since the same volume has been added to segments A and B, the cross-sectional radius or radius increase ($R_b$) of segment B will be larger than the corresponding radius or radius increase ($R_a$) for segment A. The instant pressure inside each of these elastic segments or containers varies with the inverse of the cross-sectional radius of the curvature of the elastic tubes, by virtue of the Laplace-Young law of elasticity, $$P=2\,\sigma/R \qquad \text{(Equation no. 1)}$$

where P is the pressure, σ is the surface stress and R is the cross-sectional radius of curvature.

Therefore, liquid inside segment A will actually experience more pressure from the contracting force of the elastic tube wall. While this effect is counterintuitive, it is often experienced and appreciated in the case of blowing up a balloon. The beginning portions of blowing up the balloon are much more difficult than the ending portions. The same effect occurs 1n the asymmetric tube of this illustration as described. The instant pressure in segment A will actually be larger than the pressure in segment B.

If the constriction of segment C is removed rapidly, before the pressures in segment A and segment B equalizes with the total system pressure, the liquid in the high pressure segment A will flow toward the low pressure segment B. Hence, liquid flows from segment A towards segment B in order to equalize pressure. This creates a pumping effect.

The above illustration has described the timing and frequency of the pinching process. The size of the displaced volume depends on the relative size of segment C to the size of segments A and B. The ratios of C to A as well as the timing and frequency of the pinching set various characteristics of the pump. For example, a 5 cm long tube of 1 cm in diameter can be divided to segments A=3 cm, C=1 cm and B=1 cm. At a frequency of 2 Hz and duty cycle of 20% (close to open ratio), this tube can pump up to 1.8 liters/min.

To overcome the limiting drawbacks of an elastic tube pumping requiring different elastic properties of the segments A and B in a prior art hydro elastic pump system, it is disclosed a hydroimpedance pumping system comprising changing a shape of an elastic tube element in a way which increases the pressure in a first end member adjacent segment A more than that in a second end member adjacent the segment B to move fluid between the members based on a pressure differential, wherein the elastic tube element has same elastic properties of the segments A and B and has the first and second end members with different hydroimpedance attached to each end of segment A and segment B, respectively.

Figure 2:
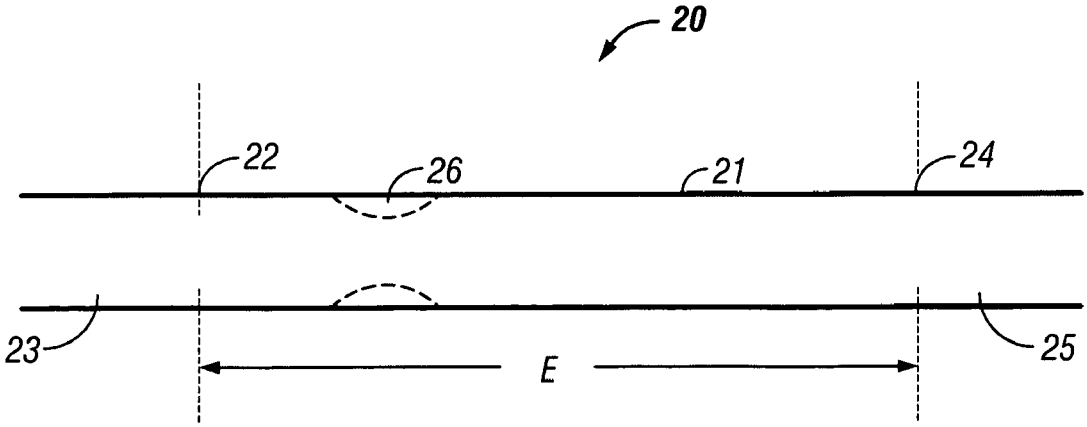
FIG. 2 is a basic hydroimpedance pump according to the principles of the present invention.

FIG. 2 shows a basic hydroimpedance pump according to the principles of the present invention. A hydroimpedance pump 20 comprises an elastic tube element 21 having two ends 22, 24 defining a length E. In one embodiment, the elastic properties or hydroimpedance of the elastic tube element 21 are essentially uniform along the full length E. In some aspect, the elastic element 21 of the present invention further comprises a first end member 23 attached to the end 22 of the elastic element 21 and a second end member 25 attached to the end 24 of the elastic element 21, wherein the lumen of the end members 23, 25 are in full fluid communication with the lumen of the elastic tube 21. The elastic tube element 21 has an impedance $Z_0$ whereas the end members 23 and 25 have impedances $Z_1$ and $Z_2$, respectively. In general $Z_0$ is different from either $Z_1$ or $Z_2$. However, $Z_1$ can be equal to or different from $Z_2$. The impedance, Z, of the present invention is a frequency dependent resistance applied to a hydrofluidic pumping system defining the fluid characteristics and the elastic energy storage of that segment of the pumping system. The following illustrations describe various possible ways of achieving the proposed concepts and principles of the present invention.

FIG. 3 shows certain mechanisms of a basic hydroimpedance pump for inducing flow direction at a sequence of time following the pinch-off initiation. In some aspect, the pump is made of a primary elastic section 21 of tubing connected by a first end member 23 having impedance Z 1 and a second end member 25 having impedance Z2 that is different from Z 1, FIG. 3 also shows the interfaces 22, 24 between the elastic section 21 and the end members 23, 25, respectively and the origin point 40 of the pinch-off by the pinching element 26. The elastic section 21 is then periodically pinchably closed, off-center from the interfaces 22, 24 to the end members 23, 25 of different impedance. At a specific frequency and duty cycle, the pinching changes the pressure, and hence acts as a pressure changing element, to causes a net directional flow inside the tubing. Selecting a different frequency and duty cycle can reverse the direction of flow.

Figure 3A:
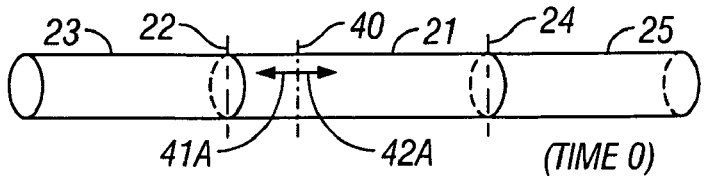
FIGS. 3*a*–3*e* shows mechanisms of a basic hydroimpedance pump for inducing flow direction at a sequence of time following the pinch-off initiation.
Figure 3B:
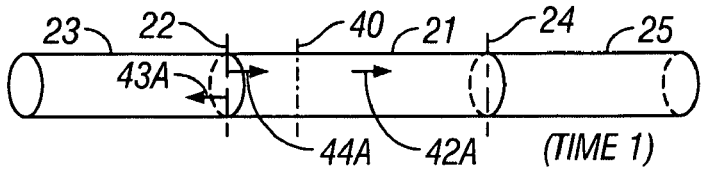
Figure 3C:
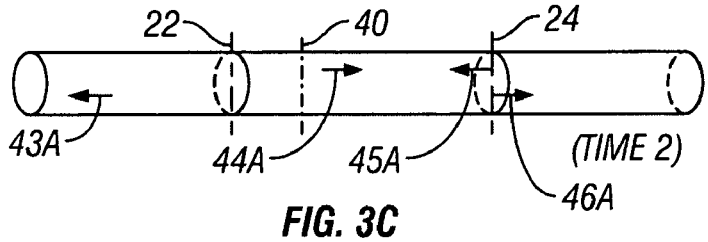
Figure 3D:
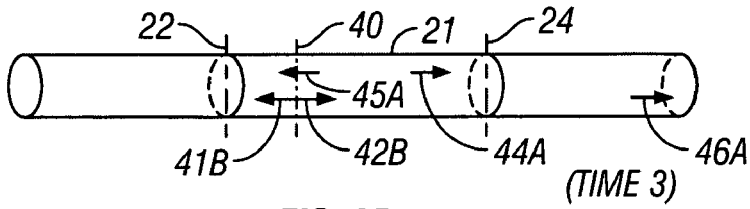

When the elastic section 21 is first pinched down at Time 0 at the origin 40, a high-pressure wave is emitted in both axial directions (arrows 41A, 42A) traveling at the same speed (FIG. 3*a*). When the pressure wave 41A encounters a shift in impedance at interface 22 at Time 1, a first portion 43A of the wave 41A continues to travel through and a second portion 44A of the wave is reflected back towards the origin 40 (FIG. 3*b*). The reflected portion 44A of the wave 41A eventually reaches the origin 40. Again at Time 2, when the pressure wave 42A encounters a shift in impedance at interface 24, a first portion 46A of the wave 42A continues to travel through and a second portion 45A of the wave is reflected back towards the origin 40 (FIG. 3*c*). The elastic section 21 may further be pinched a second time at Time 3 (FIG. 3*d*) with a high pressure wave emitted in both axial directions 41B, 42B.

Figure 3E:
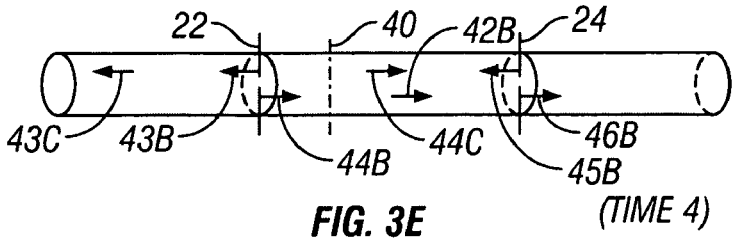

In the hydroimpedance pump of the present invention, the offset in location of the pinching and/or timing of the pinching cause the pressure wave to reflect at different intervals on the two sides. Depending on the selected frequency and duty cycle, the elastic section 21 of the primary tube will either be open or closed. If open, the wave will pass through to the other side of the tube. If closed, the wave will again be reflected back. As shown in FIG. 3*e* at Time 4, the pressure wave 41B encounters a shift in impedance at interface 22, and a first portion 43B of the wave 41B continues to travel through and a second portion 44B of the wave is reflected back towards the origin 40. At the same moment, the pressure wave 44A encounters a shift in impedance at interface 24, and a first portion 46B of the wave 44A continues to travel through and a second portion 45B of the wave is reflected back towards the origin 40. Similarly, another pressure wave 45A encountered a shift in impedance at interface 22 prior to Time 4 having a second portion 44C of the wave 45A reflected back passing the origin 40, while a first portion 43C of the wave 45A continues to travel through. A net pressure between the two sides of the pincher 26 can be created by timing the pinching in such a way that the reflected waves from one side pass through the origin 40, while the pressure wave from the other side are reflected back. There is a buildup of pressure on one side of the tube that causes a net flow to pass through (FIG. 3*e*). This buildup is limited by the viscous dissipation within the fluid.

For illustration purposes, consider the case where the pressure increases on the right hand side, the tube is initially squeezed causing a pair of pressure waves to traverse in both directions. The left-hand wave reflects on the left interface and passes through the origin. Before the right-hand wave returns to the origin, the primary tube is squeezed again. A new pair of pressure waves is released while the old waves are reflected to remain in the right-hand side. This can be repeated to continue to build up pressure. It is important, for the fluid to flow, that the pump remains open as long as possible while maintaining the pressure gradient.

Figure 4:
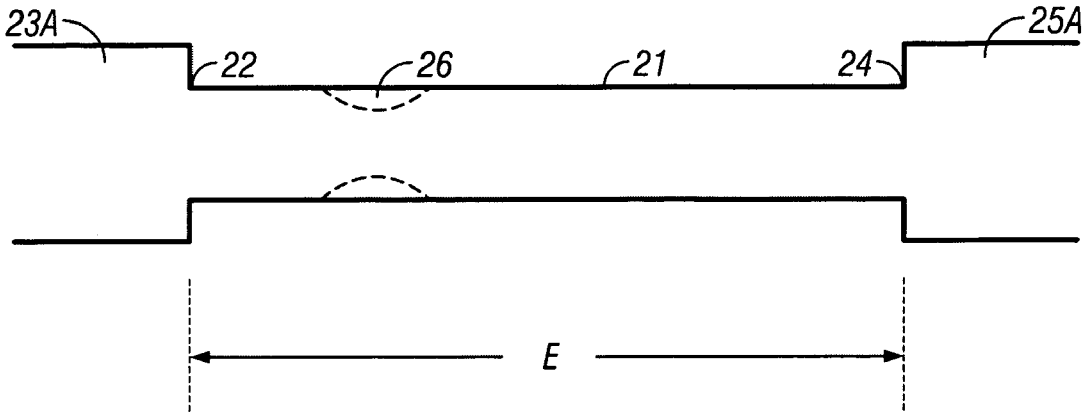
FIG. 4 is one embodiment of attaching at least one end member of larger diameter or dimension at the ends of the elastic tube element.

In one aspect, FIG. 4 shows an embodiment of attaching at least one end member 23A, 25A of larger diameter or dimension at the ends 22 and 24, respectively of the elastic tube element 21, wherein the lumen of the end members 23A, 25A are in full fluid communication with the lumen of the elastic tube 21. The expansion member 23A, 25A can have the same or different compliance, elastic properties, or impedance from that of the elastic tube element 21 or from each other. The end members can have the same or different wall thickness from that of the elastic tube element or from each other. Further, the expansion member 23A, 25A can have different cross-sectional geometry from that of the elastic tube element 21 or from each other.

The pump system of the present invention may include a feedback system with a flow and pressure sensor, which is well known to one who is skilled in the art. In one aspect, the pinching element 26 can be located at any particular position along the length E of the elastic element 21 and may be driven by a programmable driver (not shown) which also provides an output indicative of at least one of frequency, phase and amplitude of the driving. The values are provided to a processing element, which controls the timing and/or amplitude of the pinching via feedback. The relationship between timing, frequency and displacement volume for the compression cycle can be used to deliver the required performance. The parameters $Z_0$, $Z_1$ and $Z_2$, as well as the tube diameter, member diameters, and their relative elasticity can all be controlled for the desired effect. These effects can be determined by trial and error, for example. For clinical applications, one can use the given patient'variables to determine the pump parameters that are based on the patient'information. In some aspect of the present invention, it is provided a hydroimpedance pumping system comprising changing a shape of an elastic element in a way which increases the pressure in the first end member 23A more than that in the second end member 25A to move fluid between the two members based on pressure differential, wherein the elastic element 21 comprises the first member 23A and the second member 25A with different hydroimpedance attached to the end 22 and 24 of the elastic element 21, respectively.

Figure 5:
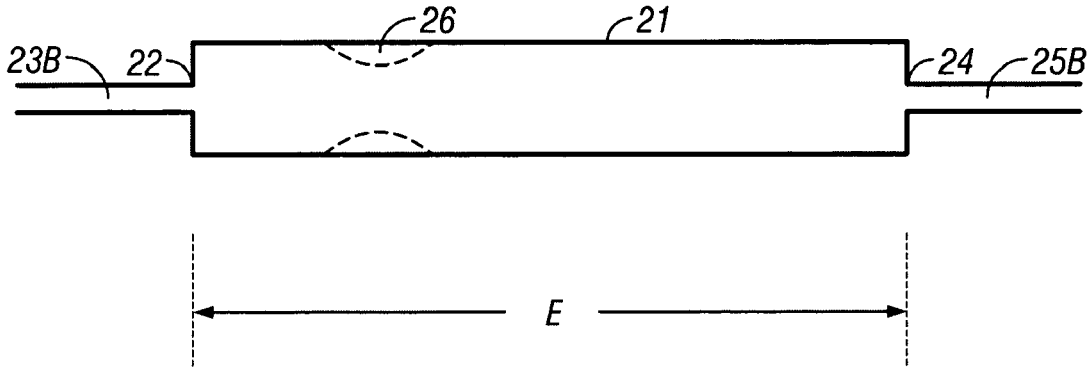
FIG. 5 is another embodiment of attaching at least one end member of smaller diameter or dimension at the ends of the elastic tube element.

In another aspect, FIG. 5 shows an embodiment of attaching at least one end member 23B, 25B of smaller diameter or dimension at the ends 22, 24 of the elastic tube element 21, wherein the lumen of the end members 23B and 25B are in full fluid communication with the lumen of the elastic tube 21. The restriction member 23B, 25B can have the same or different compliance, elastic properties or impedance from that of the elastic tube element 21 or from each other. The end members can have the same or different wall thickness from that of the elastic tube element or from each other. Further, the restriction member 23B, 25B can have different cross-sectional geometry from that of the elastic tube element 21 or from each other.

In a further aspect, the pinching element or actuating means 26 may comprise pneumatic, hydraulic, magnetic solenoid, polymeric, or an electrical stepper or DC motor. The pseudo electrical effect could be used for actuating means. The effect of contractility of skeletal muscles based on polymers or magnetic fluids, or grown heart muscle tissue can also be used. The actuating means or system may use a dynamic sandwiching of the segments or members similar to the one cited in U.S. Pat. No. 6,254,355, as will be apparent to those of skill in the art. In some aspect, it is provided a hydroimpedance pumping system comprising changing a shape of an elastic element in a way which increases the pressure in the first end member 23B more than that in the second end member 25B to move fluid between the two members based on pressure differential, wherein the elastic element 21 has the first member 23B and the second member 25B with different hydroimpedance attached to the ends 22 and 24 of the elastic element 21, respectively.

Figure 6:
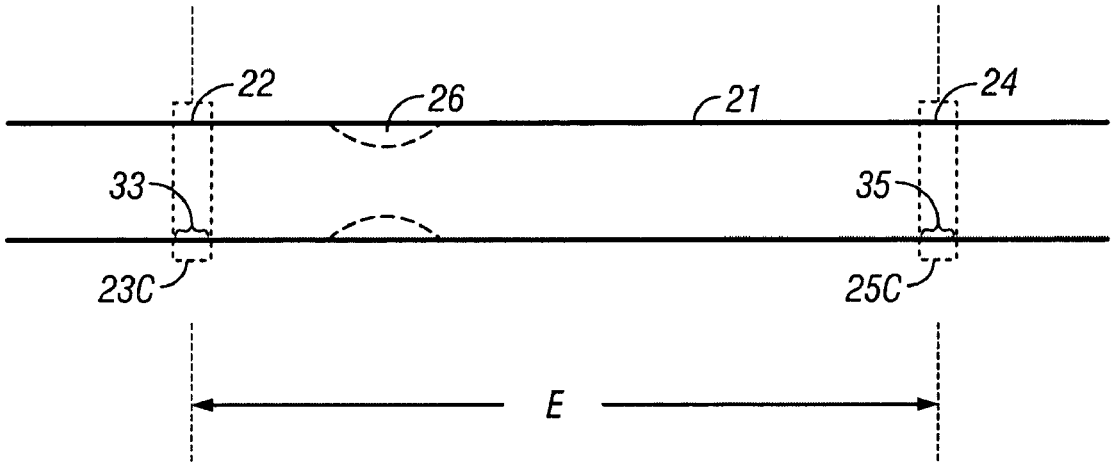
FIG. 6 illustrates one aspect of dynamically changing the conditions of the end member at the ends of the elastic tube element.

FIG. 6 illustrates one aspect of dynamically changing the conditions of the external tube or chamber 23C mounted over a first flexible wall segment 33 at the end 22 of the elastic tube element 21, whereas the external tube or chamber 25C is mounted over a second flexible wall segment 35 at the end 24 of the elastic tube element 21. The pumping is initiated and operated by stiffening or softening the flexible wall segments synchronously or asynchronously with the pinch-off process using a pinching element or means 26. By selectively applying external pressure through the external chambers 23C, 25C to the flexible wall segments 33 and 35, it is provided a hydroimpedance pumping system comprising changing a shape of an elastic element in a way which increases the pressure in the first flexible wall segment 33 more than that in the second flexible wall segment 35 to move fluid between the two segments based on pressure differential, wherein the elastic element 21 has the first flexible wall segment 33 and the second flexible wall segment 35 with different hydroimpedance attached to the ends 22 and 24 of the elastic element 21, respectively. The step of applying external pressure can be achieved by other methods such as imbedded memory alloys or magnetic fields.

Figure 7:
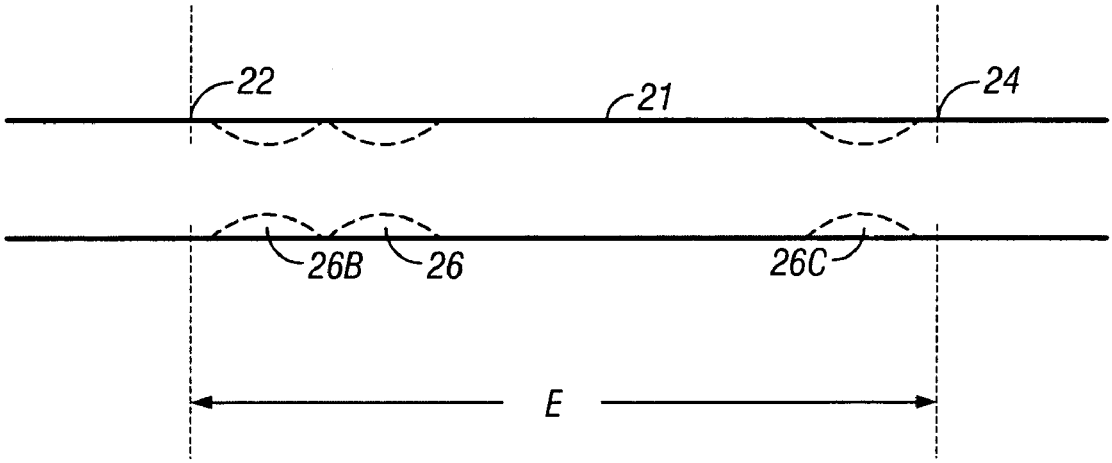
FIG. 7 illustrates another aspect of actively actuating the conditions of the elastic tube elements with multiple pinch-off actuators.

In some further aspect, FIG. 7 shows another illustration of actively actuating the conditions of the elastic tube element 21 with multiple pinch-off actuators (that are, pinching elements or means) 26B, 26C, in addition to the main pinching element or means 26. By positioning the auxiliary pinching elements 26B, 26C that are capable of producing partial or complete pinch-off at the end positions 22, 24 to reflect waves generated by the main pinching element 26, it is provided a hydroimpedance pumping system comprising changing a shape of an elastic element in a way which increases the pressure by the first auxiliary pinching element 26B at the first end 22 more than the pressure by the second auxiliary pinching element 26C at the second end to move fluid between the two ends based on pressure differential. In another aspect of the present invention, it is provided a pump comprising an elastic element having a length with a first end and a second end, a first pressure changing element disposed at about the first end and a second pressure changing element disposed at about the second end. The pump further comprises pressure change means for inducing a pressure increase and a pressure decrease into the first and second ends, in a way which causes a pressure difference between the first and second ends, and causes a pumping action based on the pressure difference, wherein the first and second pressure changing elements are capable of producing partial or complete pinch-off to reflect waves generated by the pressure change means.

The pinching means, pinching element or pinch-off actuator 26, 26B, 26C may comprise pneumatic, hydraulic, magnetic solenoid, polymeric, magnetic force, an electrical stepper, a DC motor, effect of contractility of skeletal muscles based on polymers or magnetic fluids, and grown heart muscle tissue. A number of different alternatives are also contemplated and are incorporated herein. This system without the limiting drawbacks of prior art hydro elastic tube pump that requires different elastic properties of the segments along the elastic tube can be used effectively for pumping blood. In contrast with existing blood flow systems, such as those used in traditional left ventricle devices, this system does not require any valve at all, and certainly not the complicated one-way valve systems which are necessary in existing devices. This can provide a more reliable pumping operation, since any mechanical constrictions in the blood stream provide a potential site for mechanical failure as well as sedimentation of formed blood elements and thrombosis. Hence, this system, which utilizes the hydroimpedance features but does not require a valve system, can be highly advantageous.

The elastic tube element 21, the end members 23, 25, 23A, 25A, 23B, 25B, or the end wall segments 23C, 25C of the present invention may be made of a material selected from a group consisting of silicone (e.g., Silastic™, available from Dow Corning Corporation of Midland, Mich.), polyurethane (e.g., Pellethane™, available from Dow Corning Corporation), polyvinyl alcohol, polyvinyl pyrolidone, fluorinated elastomer, polyethylene, polyester, and combination thereof. The material is preferably biocompatible and/or hemocompatible in some medical applications. The elastic tube element and the end members need not be round, but could be any shape cross section.

In one aspect of the present invention, it is provided a method for pumping fluid comprising pinching a portion of an elastic element in a way which increases a pressure in a first end member of the elastic element more than a pressure in a second end member of the elastic element without valve action, to cause a pressure differential, wherein the end members have different hydroimpedance; and using the pressure differential to move fluid between the first and second end members.

In another aspect, the step of pinching the elastic element is carried out by compressing a portion of the elastic element, wherein the step of compressing is carried out by a pneumatic pincher, by electricity that is converted from body heat based on Peltier effects, by electricity that is converted from mechanical motion of muscles based on piezoelectric mechanism. In still another aspect, the first end member has a diameter larger or smaller than a diameter of the elastic element.

EXAMPLE NO. 1

A micro hydroimpedance pump according to the principles of the present invention is used to demonstrate the feasibility. By using the same numbering system of FIG. 2, the pump 20 employs a semicircular elastic channel 21 with a cross section area 750 $(\mu m)^2$ made out of silicone rubber with a Young's modulus at about 750 kPa. The supporting substrate is a glass cover slide for the optical benefit. The actuator 26 is a 120 μm-wide and 15 μm-high channel crossing the fluid channel with a thin membrane of about 40 μm in between. When activated pneumatically, the actuator/pincher 26 squeezes one side of the fluid channel wall at a controllable frequency at 10 Hz for the current arrangement. The red food coloring with small-suspended particles was added to simulate the blood and show the pumped liquid boundaries. The end members 23, 25 with impedance mismatch ($Z_1$ for the end member 23, $Z_2$ for the end member 25, and $Z_0$ for the elastic channel 21) for the purpose of wave reflection were provided through stiffer materials at the interfaces 22, 24. We scanned the frequency of the pinching. For the above-mentioned micro hydroimpedance pump setup, the optimum frequency for the maximum pumping flow rate was about 10 Hz. The pump rate vs. frequency graph looks like an asymmetric bell. The maximal speed achieved is about 2 mm/second with a flow rate about 0.1 μL/min. The optimum frequency was very sensitive to the material properties, wall thickness, and the length of the segments.

Unlike peristaltic pumps, this pump does not necessarily implement complete squeezing or forward displacing by a squeezing action. Complete squeezing might introduce thrombogenicity or other undesired side-effects to fluid. In addition, when used in live mammals, the lack of complete squeezing means that any organism smaller than the smallest opening will likely be unharmed by any operation of the pump system. The system also does not require any permanent constrictions such as hinges, bearings and struts. This, therefore, provides an improved "wash out" condition. Again, such a condition can avoid problems such as thrombosis. The elastic energy storage concept disclosed herein can be extremely efficient, and can be used for total implantability in human body possibly driven by a natural energy resource such as the body heat and muscle action. Implanted or external elements based on the Peltier effect can be used to convert the body heat to the electricity needed to drive the pump. Also, mechanical to electrical energy converters based on piezoelectric elements or mechanism, for example can be used to harvest mechanical motion of the muscles.

Figure 8:
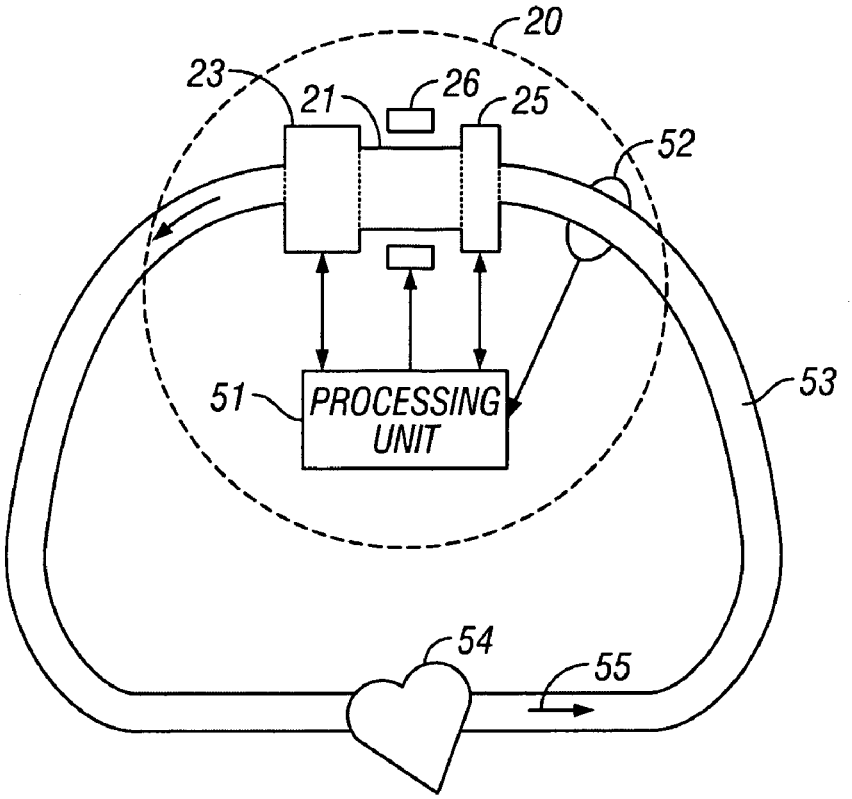
FIG. 8 shows a simulated diagram of the hydroimpedance pump system in operation.

FIG. 8 shows a simulated diagram of the hydroimpedance pump system in operation. In this embodiment, the flow circuit comprises a pump system 20 having a feedback control processing unit 51 to initiate and regulate the blood flow through a simulated diseased heart 54. The pipe 53 as described herein, can be the pipe through which the fluid is flowing (in a direction shown by an arrow 55), such as body cavity, e.g., the aorta. The pump system 20 comprises an elastic tube element 21 having two end members 23, 25, wherein the elastic properties of the elastic tube element 21 are essentially uniform along the full length between the end members. The elastic tube element 21 has an impedance $Z_0$ whereas the end members 23 and 25 have impedances $Z_1$, and $Z_2$, respectively. In general $Z_0$ is different from either $Z_1$, or $Z_2$. The impedance, Z, of the present invention is a frequency dependent resistance applied to a hydrofluidic pumping system defining the fluid characteristics and the elastic energy storage of that segment of the pumping system.

The feedback system includes a flow and pressure sensor 52. The pinching element 26 is driven by a programmable driver or other means which is incorporated in or attached to the processing unit 51, wherein the unit 51 displays the flow/pressure data and at least one of frequency, phase and amplitude of the driving. The values as provided control the timing, frequency and/or amplitude of the pinching via feedback. The relationship between timing, frequency, and displacement volume for the compression cycle can be used to deliver the required performance. For the clinical applications, one can use a patient's variables and find the pump parameters that are relevantly based on the patient's information.

FIG. 8 shows the actuating system for the compressing process being controlled by the processing unit with feedback from a flow and pressure sensor 52. Other pinch-off driving systems, including pneumatic, hydraulic, magnetic solenoid, or an electrical stepper or DC motor can also be used. The pseudo electrical effect could be used. The effect of contractility of skeletal muscles based on polymers or magnetic fluids, or grown heart muscle tissue can also be used. The system may use a dynamic sandwiching of the segments. In some aspect, it is provided a valveless pump comprising an elastic element having a length with a first end and a second end; a first end member attached to the first end of the elastic element and a second end member attached to the second end, wherein the first end member has an impedance different from an impedance of the second end member; and pressure change means for inducing a pressure increase and a pressure decrease into the first and second end members, in a way which causes a pressure difference between the first and second end members, and causes a pumping action based on the pressure difference.

In another aspect, the pressure change means comprises compressing a portion of the elastic element by a pincher, or the pressure change means comprises compressing a portion of the elastic element by electricity that is converted from body heat based on Peltier effects, or by electricity that is converted from mechanical motion of muscles based on piezoelectric mechanism.

Figure 9A:
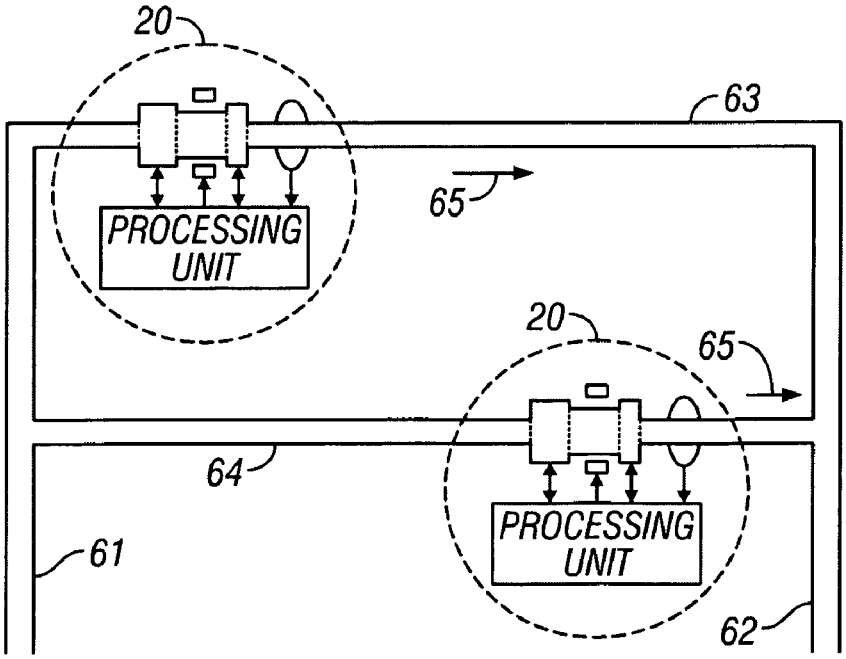
FIG. 9A shows one embodiment of operations by combining a plurality of hydroimpedance pump systems in parallel.
Figure 9B:
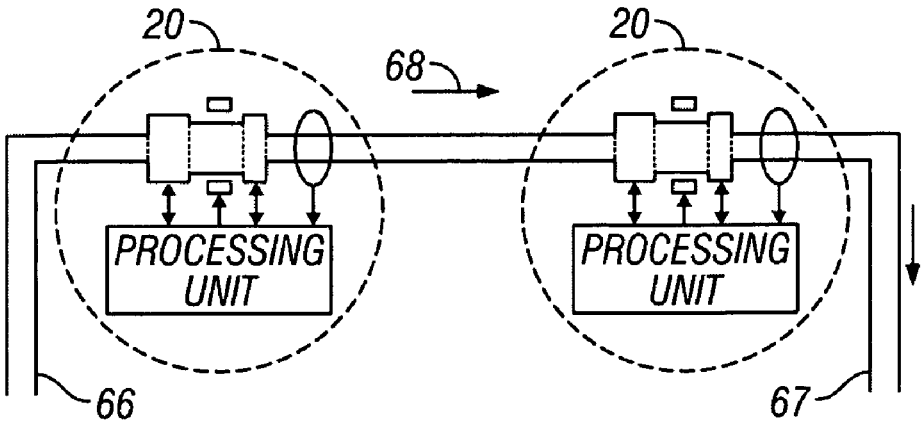
FIG. 9B shows another embodiment of operations by combining a plurality of hydroimpedance pump systems in series.
Figure 9C:
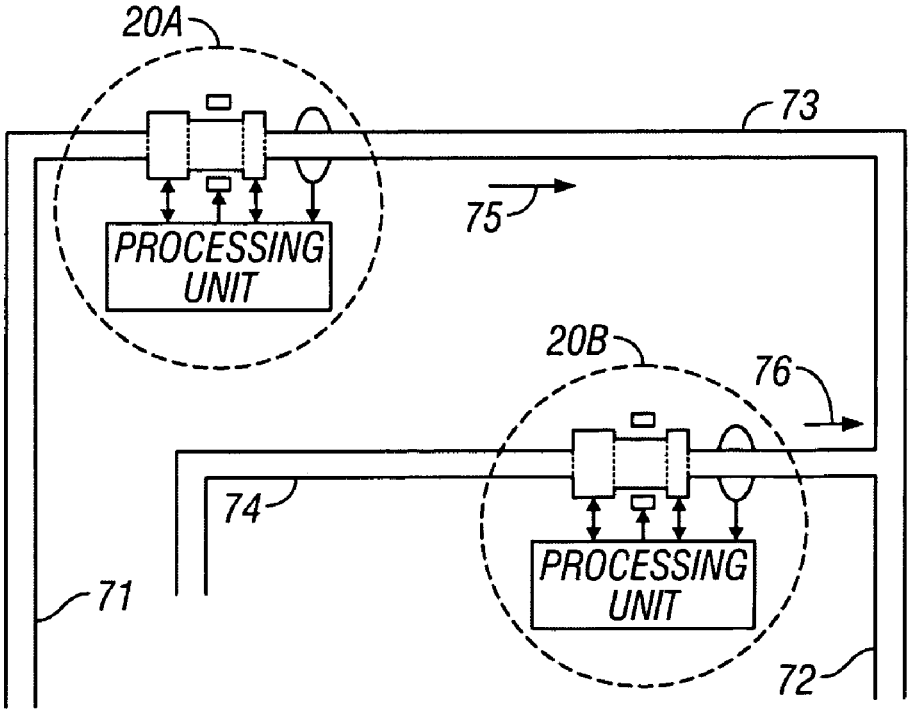
FIG. 9C shows still another embodiment of operations by mixing a plurality of hydroimpedance pump systems.

FIGS. 9A, 9B, and 9C show various modes of operations. In one embodiment as shown in FIG. 9A, the flow system by directing the fluid from a first point 61 to a second point 62 is facilitated by a combination of a plurality of hydroimpedance pump systems 20 in parallel, each system pumps fluid 63, 64 in the arrow direction 65. In another embodiment as shown in FIG. 9B, the flow system from an upstream point 66 to a downstream point 67 (as shown by an arrow 68) is facilitated by a combination of a plurality of hydroimpedance pump systems 20 in series.

In still another embodiment as shown in FIG. 9C, the flow circuit system by directing the fluid from a first point 71 to a second point 72 is enhanced by a branching-in mixing of a second hydroimpedance pump systems 20B into the first hydroimpedance pump system 20A, wherein the first system 20A pumps fluid 73 in the arrow direction 75 while the second system 20B pumps fluid 74 in the arrow direction 76. In this case, the total flow volume at the second point 72 is higher than that at the first point 71. In another preferred embodiment, the flow 74 of the second hydroimpedance pump system 20B may be reversed (as opposite to the flow direction 76) for branching-out diversion of the first flow 73. In this case, the total flow volume at the second point 72 is less than that at the first point 71. In summary, a pumping circuit system by combining a plurality of the hydroimpedance pump systems 20, 20A, 20B in any mode of parallel, series, branching-in, branching-out, or combination thereof is useful in certain medical applications.

From the foregoing description, it will be appreciated that a novel pump system of valveless hydroimpedance type and methods of use has been disclosed. While aspects of the invention have been described with reference to specific embodiments, the description is illustrative and is not intended to limit the scope of the invention. Various modifications and applications of the invention may occur to those who are skilled in the art, without departing from the true spirit or scope of the invention. The breadth and scope of the invention should be defined only in accordance with the appended claims and their equivalents.

What is claimed is:

1. A method for pumping fluid, comprising:

pinching a portion of an elastic element in a way which increases a pressure in a first end member of the elastic element more than a pressure in a second end member of the elastic element without valve action, to create pressure waves wherein the end members have different hydroimpedance; and controlling said pinching, using a controlling part that adjusts all of the timing of said pinching, frequency of said pinching and displacement of said pinching, based on a sensing of a flow and pressure, and wherein said controlling operates to control times of the pinching in a way to sum a plurality of said pressure waves such that a reflected pressure wave is summed with a created pressure wave, to cause a net pressure differential that moves fluid between said first and second end members.

2. The method according to claim 1, wherein said elastic element is an elastic tube.

3. The method according to claim 1, wherein the step of pinching the elastic element is carried out by compressing only a single portion of the elastic element.

4. The method according to claim 3, wherein the step of compressing is carried out by a pneumatic pincher.

5. The method according to claim 3, wherein the step of compressing is carried out by electricity that is converted from body heat based on Peltier effects.

6. The method according to claim 3, wherein the step of compressing is carried out by electricity that is converted from mechanical motion of muscles based on piezoelectric mechanism.

7. The method according to claim 1, wherein the first end member has a diameter larger than a diameter of the elastic element.

8. The method according to claim 1, wherein the first end member has a diameter smaller than a diameter of the elastic element.

9. A method as in claim 1, wherein said controlling controls said frequency to an optimum frequency which causes a maximum amount of pump rate based on specific characteristics of the elastic element.

10. A valveless pump, comprising:

an elastic element having a length with a first end and a second end;

a first end member attached to said first end of the elastic element and a second end member attached to said second end, wherein said first end member has an impedance different from an impedance of the second end member; and a pressure change element that induces a pressure increase and a pressure decrease into the first and second end members, in a way which creates pressure waves between said first and second end members, and a controller that controls said pressure change element to adjust both the timing of the pressure increase and decrease, and frequency of the pressure increase and pressure decrease, said controlling being carried out in a way that sums at least one of said pressure waves with at least one reflected pressure wave to form a pumping effect that is based on specific characteristics of the elastic element, in a way to cause a net pressure differential and causes a pumping action based on said pressure differential.

11. The valveless pump according to claim 10, wherein the impedance of the first end member is different from an impedance of the elastic element.

12. The valveless pump according to claim 10, wherein the elastic element is an elastic tube.

13. The valveless pump according to claim 10, wherein the first end member has a diameter larger than a diameter of the elastic element.

14. The valveless pump according to claim 10, wherein the first end member has a diameter smaller than a diameter of the elastic element.

15. The valveless pump according to claim 10, wherein said pressure change element compresses a portion of the elastic element.

16. The valveless pump according to claim 10, wherein said pressure change element comprises a pincher that compresses a portion of the elastic element by a pincher.

17. The valveless pump according to claim 10, wherein the pressure change element comprises portion of the elastic element using electricity that is converted from body heat based on Peltier effects.

18. The valveless pump according to claim 10, wherein the pressure change means comprises compressing a portion of the elastic element by electricity that is converted from mechanical motion of muscles based on piezoelectric mechanism.

19. A pump as in claim 10, wherein said maximum pumping effect is one of a maximum speed of pumping or a maximum flow rate.

20. A valveless pump, comprising:

an elastic element having a length with a first flexible wall segment and a spaced apart second flexible wall segment;

a first external chamber mounted over the first flexible wall segment and a second external chamber mounted over the second flexible wall segment, wherein a pressure is applied through the first external chamber onto the first flexible wall segment that is different from a pressure applied onto the second flexible wall segment through the second external chamber;

a pressure change part that induces a pressure increase and a pressure decrease into the first and second flexible wall segments; and a control part that controls said pressure change part in a way which causes a pressure difference between said first and second segments by using a characteristic for the pressure increase and pressure decrease which sums at least one of the pressure waves produced by the pressure change part with at least one reflected pressure wave, and causes a pumping action based on said summed pressure waves.

21. The valveless pump according to claim 20, wherein the elastic element is an elastic tube.

22. The valveless pump according to claim 20, wherein the pressure change means comprises compressing a portion of the elastic element, wherein said portion is between the first and second flexible wall segments.

23. The valveless pump according to claim 20, wherein the pressure change means comprises compressing a portion of the elastic element by a pincher, wherein said portion is between the first and second flexible wall segments.

24. The valveless pump according to claim 20, wherein the pressure change means comprises compressing a portion of the elastic element using electricity that is converted from body heat based on Peltier effects, wherein said portion is between the first and second flexible wall segments.

25. The valveless pump according to claim 20, wherein the pressure change means comprises compressing a portion of the elastic element using electricity that is converted from mechanical motion of muscles based on piezoelectric mechanism, wherein said portion is between the first and second flexible wall segments.

26. A pump as in claim 20, wherein said maximum pumping effect is one of a maximum speed of pumping or a maximum flow rate.

27. A valveless pump, comprising:

an elastic element having a length with a first end and a second end;

a first pressure changing element disposed at about the first end and a second pressure changing element disposed at about the second end;

auxiliary pressure change means for inducing a pressure increase and a pressure decrease into areas near the first and second ends, in a way which causes a pressure difference between said first and second ends, and causes a pumping action based on said pressure difference, wherein the first and second pressure changing elements are capable of producing partial or complete pinch-off to reflect waves generated by said pressure change means and a controller that adjusts a frequency of the pressure increase and pressure decrease to sum at least one of the pressure waves created by the pressure increase and pressure decrease with at least one reflected pressure wave in a way to cause a net pressure differential and causes a pumping action based on said pressure differential.

28. The valveless pump according to claim 27, wherein the elastic element is an elastic tube.

29. The valveless pump according to claim 27, wherein the pressure change means comprises compressing a portion of the elastic element.

30. The valveless pump according to claim 27, wherein the pressure change means comprises compressing a portion of the elastic element by a pincher.

31. The valveless pump according to claim 27, wherein the pressure change means comprises compressing a portion of the elastic element by electricity that is converted from body heat based on Peltier effects.

32. The valveless pump according to claim 27, wherein the pressure change means comprises compressing a portion of the elastic element by electricity that is converted from mechanical motion of muscles based on piezoelectric mechanism.

33. A pump as in claim 27, wherein said maximum pumping effect is one of maximum speed of pumping or a maximum flow rate.

* * * * *